US005081728A

United States Patent [19]

Skinner

[11] Patent Number: 5,081,728

[45] Date of Patent: Jan. 21, 1992

[54] MATTRESS AND MATTRESS COVER

[76] Inventor: Charles W. Skinner, 9375 - 209A Street, Langley, British Columbia, Canada, V1M 1S2

[21] Appl. No.: 602,212

[22] Filed: Oct. 22, 1990

[51] Int. Cl.[5] ..... A47C 27/14

[52] U.S. Cl. ..... 5/465; 5/411; 5/470; 5/481

[58] Field of Search ..... 5/411, 462, 464, 465, 5/470, 480, 481

[56] References Cited

U.S. PATENT DOCUMENTS

| | | | |
|---|---|---|---|
| 1,132,869 | 3/1915 | Nichols | 5/465 |
| 1,228,213 | 5/1917 | Hunt . | |
| 1,271,672 | 7/1918 | Crowley et al. | 5/470 X |
| 1,335,965 | 4/1920 | Hoffman | 5/480 |
| 1,423,416 | 7/1922 | Gomes . | |
| 1,423,954 | 7/1922 | Maussner . | |
| 1,457,203 | 5/1923 | Wick . | |
| 1,592,146 | 7/1926 | Miller et al. | 5/465 |
| 2,545,311 | 3/1951 | Rosberger . | |
| 2,693,847 | 11/1954 | Kablotsky | 5/481 X |
| 3,950,798 | 4/1976 | Borsini | 5/464 X |
| 4,213,214 | 7/1980 | Gilhooly | 5/481 X |

FOREIGN PATENT DOCUMENTS

| | | | |
|---|---|---|---|
| 1359362 | 3/1904 | France | 5/465 |
| 2435245 | 5/1960 | France | 5/470 |
| WO81/02384 | 9/1981 | World Int. Prop. O. . | |

*Primary Examiner*—Michael F. Trettel
*Attorney, Agent, or Firm*—Barrigar & Oyen

[57] ABSTRACT

A mattress comprising a plurality of parallel mattress blocks, and a mattress cover for retaining the mattress blocks together as a unit. The mattress cover has a plurality of projecting segments for insertion between adjacent mattress blocks.

33 Claims, 4 Drawing Sheets

MATTRESS AND MATTRESS COVER

FIELD OF THE INVENTION

This application pertains to a mattress comprising a plurality of parallel mattress blocks, and a mattress cover for retaining the mattress blocks together as a unit. The mattress cover has a plurality of projecting segments insertable between adjacent mattress blocks.

BACKGROUND OF THE INVENTION

Several mattresses are disclosed in the prior art which are comprised of removable or interchangeable mattress segments. For example, published P.C.T. application No. WO81/02384 reveals a mattress intended primarily for orthopaedic use having a number of interchangeable foam blocks of different hardnesses. The blocks are held in abutting relation by a flexible, closely fitting removable cover. However, the above-described invention suffers from the disadvantage that the cover must be removed in order to easily interchange or replace the foam block components. Furthermore, since the cover is a continuously planar sheet, it is not possible for a user to insert body appendages, such as hands or toes, between the adjacent block components after the cover has been fitted.

U.S. Pat. No. 1,457,203 granted to Wick on May 29, 1923 discloses a mattress having a base or bottom sheet constructed of a longitudinal series of parallel pockets or compartments of substantially rectangular form. The compartments may be stuffed with feathers or other filler to define a series of transversely rectangular mattress segments. The segments are apparently left separable to allow body appendages to be inserted into the slots between adjacent segments. The primary drawback of the Wick invention is that the mattress segments are not freely removable or interchangeable. Further, the pockets or compartments are permanently fastened to the base or bottom sheet; since the mattress stuffing and cover sheet are not readily separable, the mattress cover is not readily laundered.

U.S. Pat. No. 1,228,213 granted to Hunt on May 29, 1917, U.S. Pat. No. 1,423,954 granted to Maussner on July 25, 1972 and U.S. Pat. No. 2,545,311 granted to Rosberger on Mar. 13, 1951 also disclose segmented mattress constructions, but none of the above references disclose a specially adapted mattress cover having a plurality of spaced apart pleats adapted for insertion within the transverse spaces defined by adjacent mattress segments.

SUMMARY OF THE INVENTION

In accordance with the invention, there is provided a mattress having a plurality of parallel mattress blocks and a mattress cover for covering the mattress blocks. The mattress cover has a plurality of transverse, projecting segments insertable between the mattress blocks.

Preferably the mattress cover is a continuous flexible sheet for holding the mattress blocks together as a unit and the projecting segments are V-shaped pleats in the flexible sheet. The pleats may be spaced-apart at equal intervals.

Advantageously the mattress blocks are parallelepiped in shape, having opposed top and bottom surfaces, opposed side surfaces, and opposed end surfaces. The mattress cover is preferably constructed from a plurality of sheet sections each section having a generally rectangular central portion for covering the top surface of one of the mattress blocks, a pair of opposed, generally rectangular flap portions joined to the lateral edges of the central portion for covering the end surfaces of one of the mattress blocks, and a pair of opposed, generally rectangular side portions for covering the side surfaces of the mattress blocks. Preferably the side portions are respectively joined to the central portion along opposed longitudinal edges thereof, and the side portions of adjacent sheet sections are joined along adjacent longitudinal edges to define the transverse cover segments.

In one embodiment, each of the flap portions is movable relative to its respective sheet section central portion to expose an end surface of one of the blocks, thereby enabling removable and interchange of the blocks without removing the cover from the mattress. The flap portions may include fastening means for releasably fastening the flap portions to the block end surfaces. The flap fastening means of adjacent sheet sections may be integrally joined together to form a continuous band extending along the longitudinal edges of the mattress. Advantageously, the fastening means is a strip of hook-type fastening material.

In an alternative embodiment, the mattress may be supported on a frame having vertical sidewalls, and the flap portion hook-type fastening material may be releasably fastened to a complimentary strip of loop-type fastening material extending along a longitudinal edge of the frame sidewalls.

In a further alternative embodiment, the opposed edges of the flap portions may be joined to the corresponding edges of the associated side portions. In yet another embodiment, the flap portions of adjacent sheet sections may be joined together to form a continuous skirt extending along the longitudinal sides of the mattress.

Advantageously, the mattress blocks are foam blocks of varying density and dimension arranged such that the mattress has a generally rectangular outline. The mattress blocks may be arranged so that the mattress is subdivided along a longitudinal axis into longitudinal regions of different resiliency. The mattress blocks meeting along the longitudinal axis are held in abutting relation by the mattress cover. Preferably, the abutting surfaces of the blocks meeting along the longitudinal axis are tapered at an angle of between 30° and 60° relative to a vertical axis.

Foam blocks of relatively smaller dimension are preferably positioned in the feet and shoulder supporting regions of the mattress and at least one foam block of relatively larger dimension is positioned in the central torso supporting region of the mattress.

The mattress, mattress cover and supporting frame may be sold individually or as a complete package.

BRIEF DESCRIPTION OF THE DRAWINGS

FIG. 1(*b*) is an oblique pictorial illustration of the mattress of FIG. 1(*a*) comprised of mattress blocks of differing dimensions and illustrating a pair of blocks with tapered end portions meeting along the central longitudinal axis of the mattress.

FIG. 1(*c*) is an oblique pictorial illustration of the mattress of FIG. 1(*b*) with one of the mattress blocks removed to define a transverse recessed portion.

DETAILED DESCRIPTION OF THE PREFERRED EMBODIMENT

The present invention is directed to a mattress 10 comprised of a plurality of spaced mattress blocks 12, and a mattress cover 14 for retaining mattress blocks 12 together as a unit.

Figure 1A:
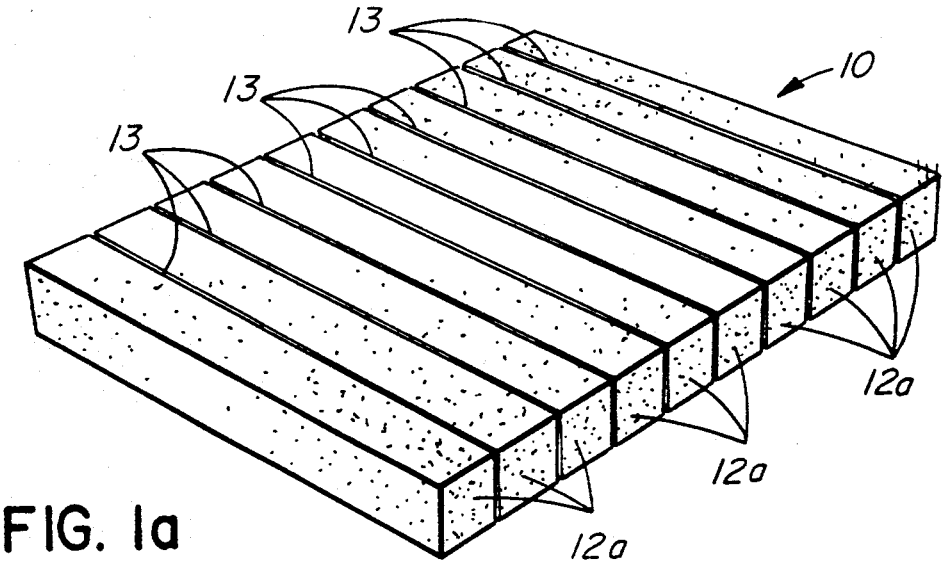
FIG. 1(*a*) is an oblique pictorial illustration of an uncovered mattress constructed in accordance with the invention showing the spaced, parallel mattress blocks.
Figure 1B:
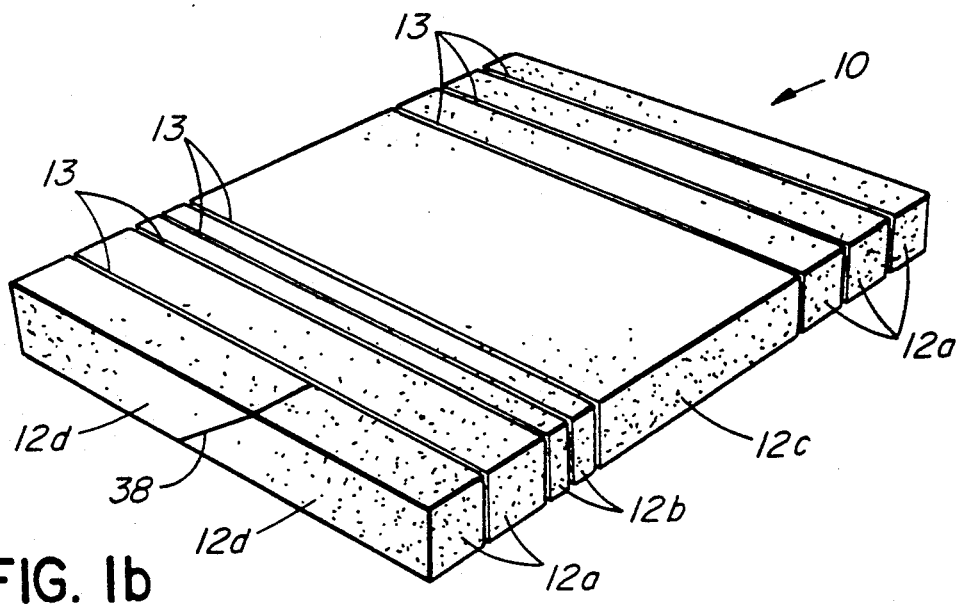
Figure 1C:
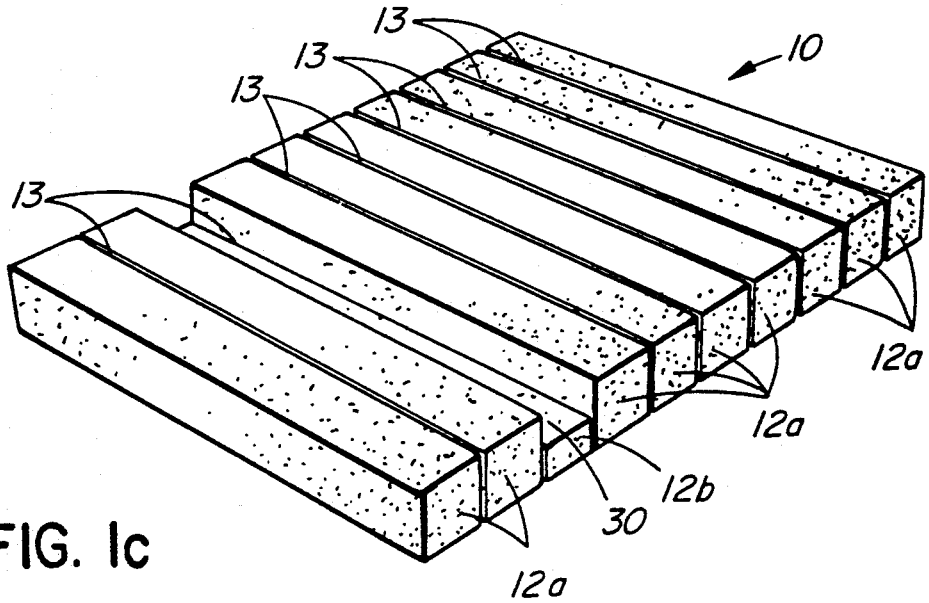

With reference to FIGS. 1(*a*)–(*c*), mattress blocks 12 are preferably parallelepiped-shaped foam blocks of differing density and dimensions. Mattress blocks 12 are arranged in a parallel array to form a mattress 10 of rectangular outline, subdivided lengthwise. Narrow, transverse spaces 13 are defined between adjacent mattress blocks 12.

Mattress blocks 12 are freely separable and interchangeable so that blocks of relatively greater or lesser density may be selectively positioned to support different areas of the body. For example, mattress blocks 12 may be distributed so that relatively dense, firm blocks 12 are placed in the central torso supporting region of mattress 10 and relatively soft blocks 12 are placed in the head and shoulder supporting region of mattress 10. Thus, the firmness characteristics of mattress 10 may be easily adjusted to suit the personal preferences or orthopaedic requirements of a particular user.

FIG. 1(*a*) illustrates one embodiment of mattress 10 constructed of a parallel series of elongate blocks 12(*a*). The length of each block 12(*a*) spans the full transverse width of mattress 10. The width and depth of blocks 12(*a*) are preferably equal to define square-shaped end surfaces.

FIG. 1(*b*) illustrates an alternative embodiment of mattress 10 constructed of a parallel series of mattress blocks 12(*a*), 12(*b*) and 12(*c*) of differing dimensions. Blocks 12(*b*) are dimensioned so that the width of each block 12(*b*) is approximately ½ the width of blocks 12(*a*). Block 12(*c*) is dimensioned so that its width exceeds the width of blocks 12(*a*), usually by a multiple of 3–5. As discussed further below, the relatively small size blocks 12(*b*) are usually positioned in the shoulder and feet supporting regions of mattress 10, and the relatively large size block 12(*c*) is usually positioned in the central torso supporting region of mattress 10.

FIG. 1(*b*) also depicts an alternative pair of blocks 12(*d*) which each span only part way across mattress 10. The abutting surfaces 38 of blocks 12(*d*), which meet along the central longitudinal axis of mattress 10, are preferably tapered at an angle between 30° and 60° relative to a vertical axis. Blocks 12(*d*) are provided if it is necessary to divide mattress 10 longitudinally into regions of differing resiliency. In this regard, queen and king size beds are often shared by two individuals who may have differing mattress firmness preferences or orthopaedic support requirements. Thus, two or more mattress blocks 12(*d*) of differing density may be aligned to span the full transverse dimension of mattress 10. Blocks 12(*d*) are tapered along their abutting ends 38 to provide a constant degree of compression in the central longitudinal region of mattress 10 and to prevent separation of the abutting block surfaces.

FIG. 1(*c*) illustrates a further alternative embodiment of mattress 10 wherein one of the relatively small size blocks 12(*b*) has been removed and the other companion block 12(*b*) has been rotated 90° to define a recessed portion 30.

Figure 2:
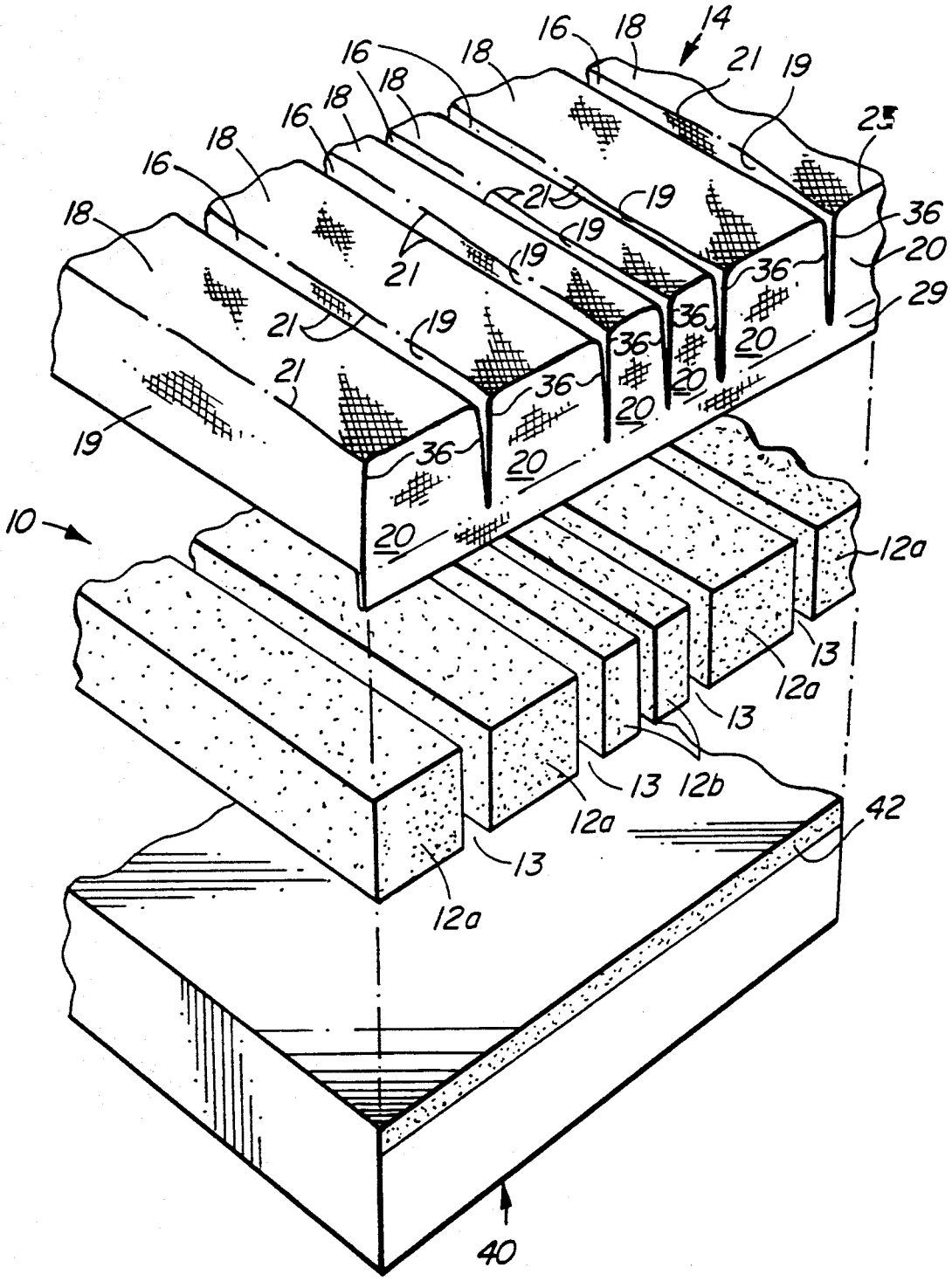
FIG. 2 is an fragmented, exploded view of the mattress, mattress cover and bed frame of the present invention.
Figure 5:
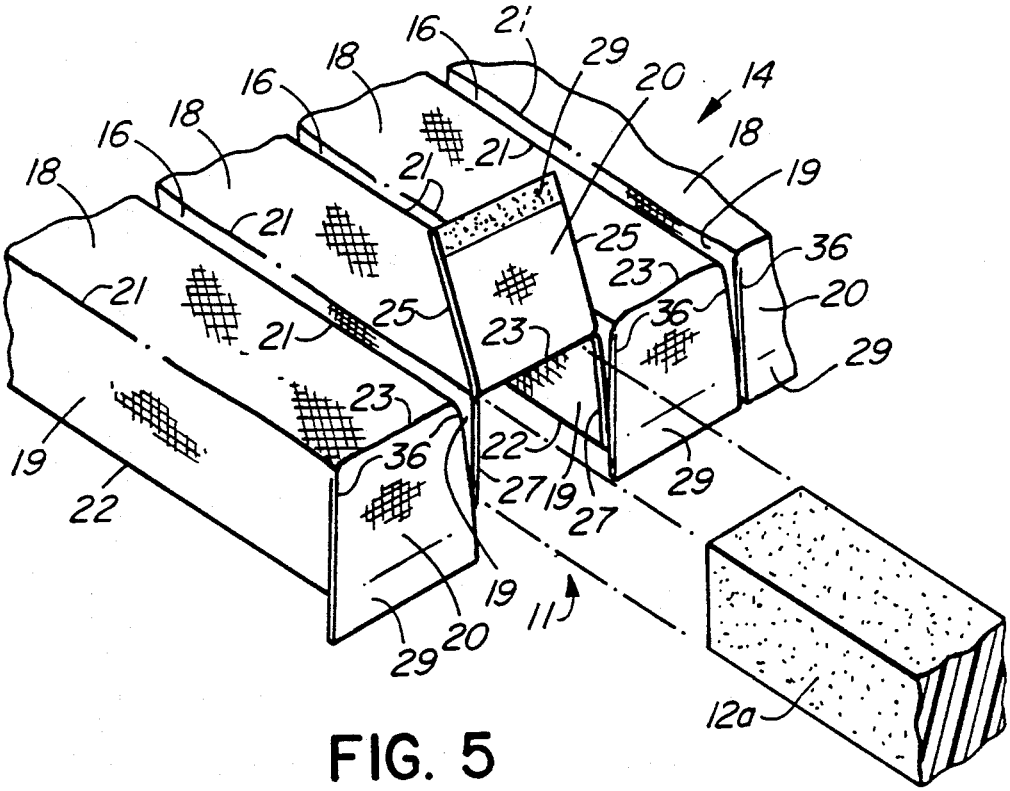
FIG. 5 is a fragmented, oblique view of an alternative embodiment of the mattress cover with the top surfaces of adjacent mattress blocks forced apart to show the cover segments inserted between adjacent mattress blocks and with one cover flap raised to expose an open-bottomed block receiving pocket.

As shown in FIG. 2, mattress cover 14 is provided to retain the separate mattress blocks 12 together as a unit. Mattress cover 14 is a continuous flexible sheet having a plurality of transverse, downwardly projecting segments 16 insertable within the spaces 13 between adjacent mattress blocks 12. Cover segments 16 are preferably V-shaped pleats which define a series of open-bottomed pockets 11 in the undersurface of the cover sheet for receiving and retaining mattress blocks 12 (FIG. 5). As shown in FIG. 2, mattress cover 14 may be configured to overlie mattress blocks 12 of differing dimension, such as standard size blocks 12(*a*) and relatively smaller size blocks 12(*b*). Analogous modifications (not shown) must be made to accommodate relatively large size blocks 12(*c*).

Since cover 14 is not a conventional, continuous planar sheet, the present invention enables a user to insert body appendages, such as arms or feet, between adjacent mattress blocks 12 after cover 14 is fitted over mattress 10. This allows the user to assume a more comfortable sleeping position. For example, if the user typically sleeps on his stomach, he can insert his feet and arms between adjacent mattress blocks 12 to limit neck and back strain, in much the same manner as one would when resting on a sandy beach. Usually a series of smaller size blocks 12(*b*) are positioned in the feet and upper arm supporting regions of mattress 10 to provide a greater degree of adjustability in those regions.

A large size block 12(*c*) may be positioned in the central region of mattress 10 since a gradient of foam densities is not usually required in this region. Substituting a single large size block 12(*c*) for a plurality of standard size blocks 12(*a*) makes mattress 10 easier to assemble and cheaper to fabricate.

Further, relatively soft mattress blocks 12 may be selectively positioned in the shoulder supporting regions of mattress 10 so that the user's shoulders sink below the plane of the remainder of the user's body. One advantage of this configuration is that the user's head is maintained substantially coplanar with the central torso of his body when the user rests on his back or side. Accordingly, no pillow is required to prop the user's head above the plane of the remainder of his body. As a result of the novel construction of the applicant's mattress 10 and mattress cover 14, the user can rest with his spine in a more natural orientation which helps to limit back and neck strain.

As shown in FIG. 1(*c*), mattress 10 may also be configured to define a transverse recessed portion 30. This configuration is particularly suitable for overweight users, or users with large upper torsos who have a propensity to sleep on their stomachs. As a result of the novel construction of mattress cover 14, the cover sheet may rest flush with the top surface of mattress block 12(*b*) (FIG. 1(*c*)), thereby substantially exposing the full recessed portion 30. This advantage is not realizable with conventional, continuously planar fitted sheets. Such closely-fitting sheets would tend to sag to a minor extent overlying a recess 30, but would not permit comfortable insertion of body appendages within recess 30 in the manner contemplated by the present invention.

Figure 3:
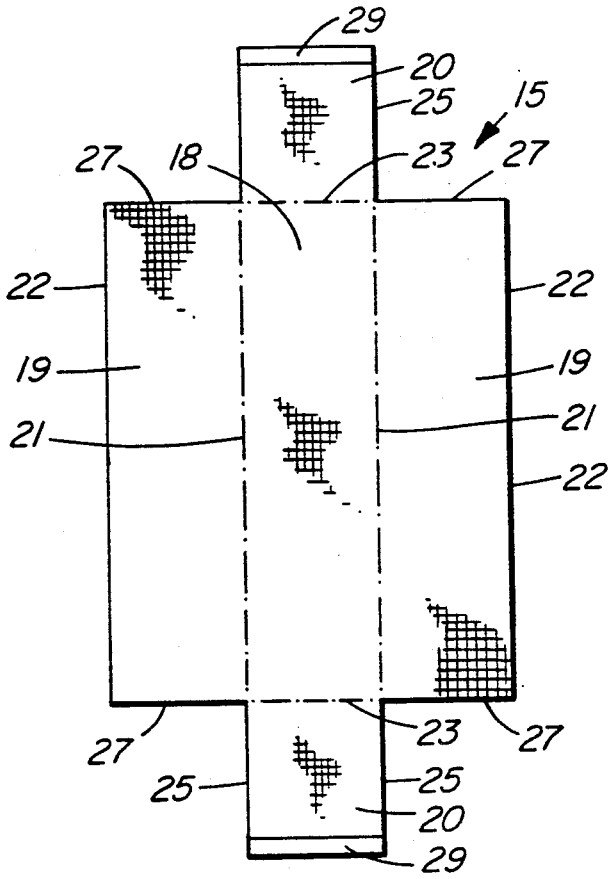
FIG. 3 is a top, plan view of a single mattress cover section in laid-flat configuration.
Figure 4:
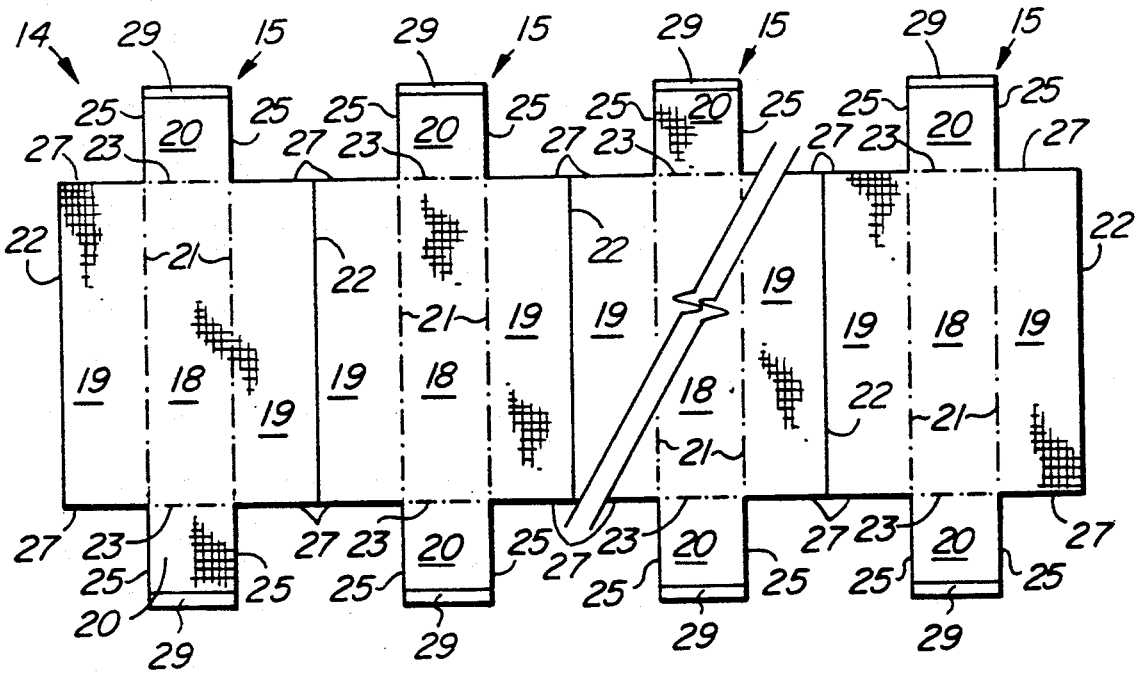
FIG. 4 is a fragmented, top, plan view of a plurality of mattress cover sections of FIG. 3 stitched together to form the continuous mattress cover of the present invention, and shown laid flat.

FIGS. 3 and 4 illustrate the pattern for constructing cover 14 from a plurality of cover sections 15. As shown in FIG. 3, each cover segment 15 includes a rectangular central portion 18 for covering the top surface of a mattress block 12, two rectangular side portions 19 of equal dimension joined to the longitudinal edges 21 of central portion 18 for covering the side surfaces of a mattress block 12, and two flap portions 20 joined to the lateral edges 23 of central portion 18 for covering the end surfaces of a mattress block 12. As should be apparent to someone skilled in the art, the size of cover portions 18 will vary depending upon the size of blocks 12 comprising mattress 10. For example, if mattress 10 includes a larger size block 12(*c*), then cover 14 must include a corresponding cover segment 15 having a central portion 18 of equivalent surface area.

Downwardly projecting cover segments 16 are constructed by joining side portions 19 of adjacent cover segments 15 together along edges 22 (FIG. 4) and folding side portions 19 downwardly relative to central portions 18 along longitudinal edges 21. Flap portions 20 are similarly folded downwardly relative to central portions 18 along lateral edges 23.

As shown in FIGS. 3–5, flap portions 20 preferably include a strip of fastening material 29. As described further below, fastening material 29 is provided for fastening cover 14 to the end surfaces of blocks 12 or to the side of a bed frame 40 supporting mattress 10.

In one embodiment of the invention, as shown in FIG. 2, the flap portions 20 of each cover segment 15 are integrally joined to the associated side portions 19 along corners 36. (With reference to FIG. 3, corners 36 are provided by stitching the opposed side edges 25 of flap portions 20 to the corresponding lateral edges 27 of associated side portions 19). Preferably flap portion edges 25 are longer than side portion edges 27 so that fastening material 29 extends below side portions 19 when cover segments 15 are folded as described above.

In the embodiment shown in FIG. 2, fastening material 29 of adjacent cover sections 15 is joined together to form a continuous band of material. Preferably fastening material 29 consists of a strip of hook-type VELCRO TM fastening material which may be releasably fastened to a complimentary strip of loop-type VELCRO TM material 42 extending longitudinally along the side of bed frame 40.

FIG. 5 illustrates an alternative embodiment of the invention wherein flap portion edges 25 are detached from associated side portion edges 27 along corners 36. In this embodiment, fastening material 29 of adjacent flap portions 20 is also detached. This enables each flap portion 20 to be independently moved relative to its respective central portion lateral edge 23 to expose block receiving pocket 11. The primary advantage of this embodiment is that blocks 12 may be withdrawn from mattress 10 and interchanged without the need to remove cover 14. In order to remove a selected mattress block 12, a user need only detach fastening material 29 of selected flap portion 20 from the complimentary fastening strip 42 on bed frame 40 (FIG. 2) and lift flap portion 20 upwardly to expose inner pocket 11 housing the selected mattress block 12. The selected mattress block 12 may then be removed from its particular pocket 11 by sliding it outwardly (FIG. 5). Since mattress blocks 12 are freely separated, the remainder of mattress 10 is left intact. The user may then insert a replacement mattress block 12 of differing density or size into the empty pocket 11 to adjust the firmness of mattress 10 as discussed above.

Figure 6:
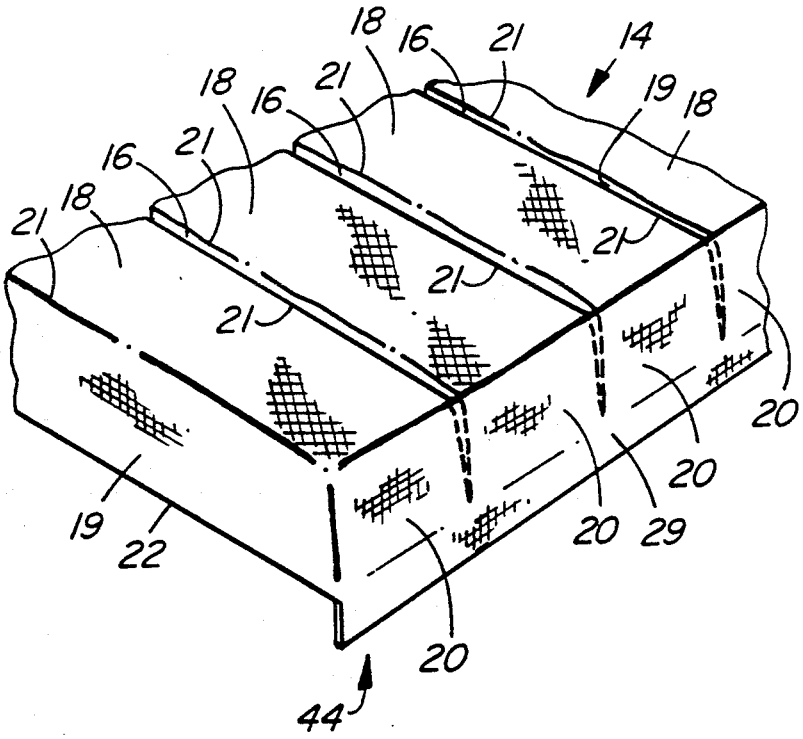
FIG. 6 is a fragmented, oblique view of an alternative embodiment of the mattress cover showing adjacent cover flaps joined to form a continuous skirt extending along a longitudinal edge of the mattress.

FIG. 6 illustrates a further alternative embodiment of the invention wherein adjacent flap portions 20 are integrally joined together to form a continuous skirt 44 extending along the longitudinal sides of mattress 10. Skirt 44 may be stitched to the remainder of cover 14 along only the upper edge thereof to facilitate interchange of mattress blocks 12. In order to remove a selected mattress block 12, a user need only detach skirt fastening material 29 in the manner described above and lift the fastening material 29 in the manner described above and lift the entire skirt 44 upwardly to expose inner pockets 11 housing mattress blocks 12 (FIG. 5). Skirt 44 is preferably elasticized to assist in retaining mattress blocks 12 together as a unit.

Referring to FIG. 2, the applicant envisions that the customized bed frame 40 may be sold together with mattress 10 and cover 14 as a complete package. It is important to emphasize, however, that bed frame 40 is not necessarily required in order to maintain mattress blocks 12 together as a unit. This function may be solely accomplished by mattress cover 14 due its novel construction. For example, flap portion fastening material 29 may be attached directly to mattress blocks 12 rather than to bed frame 40. Moreover, as should be apparent to someone skilled in the art, pre-existing water bed frames and the like may be easily modified to act as a pedestal frame for mattress 10 so that the user need only purchase mattress 10 and cover 14.

In other alternative embodiments, mattress blocks 12 may use suspension means other than foam, such as springs, feathers, polyester, polyurethane or dacron.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

I claim:

1. A mattress and mattress cover, comprising:

(a) a mattress comprising a plurality of parallel, generally parallelepiped-shaped mattress blocks, each mattress block having opposed top and bottom surfaces, opposed side surfaces, and opposed end surfaces; and (b) a mattress cover for removably covering said mattress blocks, said cover comprising a plurality of sheet sections, each sheet section comprising;

(i) a generally rectangular central portion for covering the top surface of one of said mattress blocks;

(ii) a pair of opposed, generally rectangular side portions for covering the side surfaces of one of said mattress blocks, said side portions being respectively joined to said central portion along opposed longitudinal edges thereof, wherein the side portions of adjacent sheet sections are joined along adjacent longitudinal edges to define transverse, projecting segments insertable between said mattress blocks; and (iii) a pair of opposed, generally rectangular flap portions joined to the lateral edges of said central portion for covering the end surfaces of one of said mattress blocks, wherein each of said flap portions is movable relative to its respective sheet section central portion to expose an end surface of one of said blocks, thereby enabling removal and interchange of said blocks without removing said cover from said mattress.

2. A mattress and mattress cover as defined in claim 1, wherein each of said flap portions further comprise fastening means for releasably fastening said flap portions to said block end surfaces.

3. A mattress and mattress cover as defined in claim 2, wherein the flap fastening means of adjacent sheet sections are integrally joined together to form a continuous band extending along the longitudinal sides of said mattress.

4. A mattress and mattress cover as defined in claim 3, wherein said fastening means comprises a strip of hook-type fastening material.

5. A mattress and mattress cover as defined in claim 4, wherein said fastening means comprises hook-type fastening material releasably fastenable to complementary loop-type fastening material extending along a longitudinal edge of said frame sidewalls.

6. A mattress and mattress cover as defined in claim 1, wherein said mattress is supported on a frame having vertical sidewalls, and wherein each of said flap portions further comprise fastening means for releasably fastening said flap portions to said frame sidewalls.

7. A mattress and mattress cover, comprising:

(a) a mattress comprising a plurality of parallel mattress blocks of varying density arranged such that said mattress has a generally rectangular outline; and (b) a mattress cover for covering said mattress blocks, said mattress cover comprising a sheet having a plurality of transverse, projecting segments insertable between said blocks, wherein said mattress blocks are arranged such that said mattress is subdivided along a longitudinal axis into longitudinal regions of different resiliency, and wherein said blocks meeting along said longitudinal axis are held in abutting relation by said cover.

8. A mattress and mattress cover as defined in claim 7, wherein the abutting surfaces of said blocks meeting along said longitudinal axis are tapered at an angle of between 30° and 60° relative to a vertical axis.

9. A mattress cover for removably covering a mattress comprising a plurality of parallel, generally parallelepiped-shaped mattress blocks, each mattress block having opposed top and bottom surfaces, opposed side surfaces, and opposed end surfaces, said mattress cover comprising a plurality of sheet sections, each sheet section comprising:

(i) a generally rectangular central portion for covering the top surface of one of said mattress blocks;

(ii) a pair of opposed, generally rectangular side portions for covering the side surfaces of one of said mattress blocks, said side portions being respectively joined to said central portion along opposed longitudinal edges thereof, wherein the side portions of adjacent sheet sections are joined along adjacent longitudinal edges to define transverse segments insertable between said mattress blocks; and (iii) a pair of opposed, generally rectangular flap portions joined to the lateral edges of said central portion for covering the end surfaces of one of said mattress blocks, wherein each of said flap portions is movable relative to its respective sheet section central portion to expose an end surface of one of said blocks, thereby enabling removal and interchange of said blocks without removing said cover from said mattress.

10. A mattress cover as defined in claim 9, wherein each of said flap portions further comprise fastening means for releasably fastening said flap portions to said block end surfaces.

11. A mattress cover as defined in claim 10, wherein the flap fastening means of adjacent sheet sections are integrally joined together to form a continuous band extending along the longitudinal sides of said mattress.

12. A mattress cover as defined in claim 10, wherein said fastening means comprises a strip of hook-type fastening material.

13. A mattress cover as defined in claim 9, wherein said mattress is supported on a frame having vertical sidewalls, and wherein each of said flap portions further comprises fastening means for releasably fastening said flap portions to said frame sidewalls.

14. A mattress cover as defined in claim 13, wherein said fastening means comprises hook-type fastening material releasably fastenable to complementary loop-type fastening material extending along a longitudinal edge of said frame sidewalls.

15. A combination mattress, mattress cover and bed frame, comprising:

(a) a mattress comprising a plurality of parallel mattress blocks of generally parallelepiped shape, each block having opposed top and bottom surfaces, opposed side surfaces and opposed end surfaces;

(b) a mattress cover for removably covering said mattress, said cover comprising a sheet having a sheet portion for covering the upper surface of said mattress, a plurality of transverse projecting segments attached to said sheet portion insertable between said blocks, said sheet further comprising a plurality of flaps attached to said sheet portion for covering said mattress block end surfaces; and (c) a bed frame having vertical sidewalls, wherein said frame sidewalls comprise longitudinally extending fastening means for releasably fastening said flaps to said sidewalls.

16. A mattress and mattress cover, comprising:

(a) a mattress comprising a plurality of parallel mattress blocks of varying density and dimension arranged such that said mattress has a generally rectangular outline; and (b) a mattress cover for covering said mattress blocks, said mattress cover comprising a sheet having a plurality of transverse, projecting segments insertable between said blocks, wherein a plurality of blocks of relatively smaller dimension are positioned in the feet and shoulder supporting regions of said mattress.

17. A mattress and mattress cover as defined in claim 16, wherein at least one block of relatively larger dimension is positioned in the central torso supporting region of said mattress.

18. A mattress and mattress cover, comprising:

(a) a mattress comprising a plurality of parallel, generally parallelepiped-shaped mattress blocks, each mattress block having opposed top and bottom surfaces, opposed side surfaces, and opposed end surfaces; and (b) a mattress cover for removably covering said mattress blocks, said mattress cover comprising a plurality of sheet sections, each sheet section comprising;

(i) a generally rectangular central portion for covering the top surface of one of said mattress blocks;

(ii) a pair of opposed, generally rectangular side portions for covering the side surfaces of one of said mattress blocks, said side portions being respectively joined to said central portion along opposed longitudinal edges thereof, wherein the side portions of adjacent sheet sections are joined along adjacent longitudinal edges to define transverse, projecting segments insertable between said mattress blocks;

(iii) a pair of opposed, generally rectangular flap portions joined to the lateral edges of said central portion for covering the end surfaces of one of said mattress blocks; and (iv) fastening means on said flap portions remote from said central portion for releasably fastening said cover on said mattress.

19. A mattress and mattress cover as defined in claim 18, wherein said fastening means of adjacent sheet sections is integrally joined together to form a continuous band extending along the longitudinal sides of said mattress.

20. A mattress and mattress cover as defined in claim 19, wherein said fastening means comprises a strip of hook-type fastening material fastenable to said block end portions.

21. A mattress and mattress cover as defined in claim 18, wherein said mattress is supported on a frame having vertical sidewalls, and wherein said fastening means is adapted for releasably fastening said flap portions to said frame sidewalls.

22. A mattress and mattress cover as defined in claim 21, wherein said fastening means comprises hook-type fastening material releasably fastenable to complementary loop-type fastening material extending along a longitudinal edge of said frame sidewalls.

23. A mattress and mattress cover as defined in claim 18, wherein opposed edges of each of said flap portions are joined to corresponding edges of the associated side portions.

24. A mattress and mattress cover as defined in claim 18, wherein said flap portions of adjacent sheet sections are joined together to form a continuous skirt extending along the longitudinal sides of said mattress.

25. A mattress and mattress cover as defined in claim 24, wherein said skirt is elasticized.

26. A mattress cover for removably covering a mattress comprising a plurality of parallel, parallel-epiped-shaped mattress blocks, each mattress block having opposed top and bottom surfaces, opposed side surfaces, and opposed end surfaces, said mattress cover comprising a plurality o sheet sections, each sheet section comprising:

(i) a generally rectangular central portion for covering the top surface of one of said mattress blocks;

(ii) a pair of opposed, generally rectangular side portions for covering the side surfaces of one of said mattress blocks, said side portions being respectively joined to said central portion along opposed longitudinal edges thereof, wherein the side portions of adjacent sheet sections are joined along adjacent longitudinal edges to define transverse segments insertable between said mattress blocks;

(iii) a pair of opposed, generally rectangular flap portions joined to the lateral edges of said central portion for covering the end surfaces of one of said mattress blocks; and (iv) fastening means on said flap portions remote from said central portion for releasably fastening said cover on said mattress.

27. A mattress cover as defined in claim 26, wherein said fastening means of adjacent sheet sections is integrally joined together to form a continuous band extending along the longitudinal sides of said mattress.

28. A mattress cover as defined in claim 27, wherein said fastening means comprises a strip of hook-type fastening material fastenable to said block end portions.

29. A mattress cover as defined in claim 26, wherein said mattress is supported on a frame having vertical sidewalls, and wherein said fastening means is adapted for releasably fastening said flap portions to said frame sidewalls.

30. A mattress cover as defined in claim 29, wherein said fastening means comprises hook-type fastening material releasably fastenable to complementary loop-type fastening material extending along a longitudinal edge of said frame sidewalls.

31. A mattress cover as defined in claim 26, wherein opposed edges of each of said flap portions are joined to corresponding edges of the associated side portions.

32. A mattress cover as defined in claim 26, wherein said flap potions of adjacent sheet sections are joined together to form a continuous skirt extending along the longitudinal sides of said mattress.

33. A mattress cover as defined in claim 32, wherein said skit is elasticized.

* * * * *